US006648634B2

(12) United States Patent
Nava

(10) Patent No.: US 6,648,634 B2
(45) Date of Patent: Nov. 18, 2003

(54) THERMOSHRINKING TUNNEL OVEN FOR MAKING THERMOSHRINKING PLASTIC MATERIAL FILM PACKAGE AND THE PACKAGING METHOD PERFORMED THEREBY

(76) Inventor: Paolo Nava, Via Piazzalunga, 30, 24015 S. Giovanni Bianco (Bergamo) (IT)

( * ) Notice: Subject to any disclaimer, the term of this patent is extended or adjusted under 35 U.S.C. 154(b) by 0 days.

(21) Appl. No.: 10/199,534

(22) Filed: Jul. 19, 2002

(65) Prior Publication Data

US 2003/0044744 A1 Mar. 6, 2003

(30) Foreign Application Priority Data

Aug. 29, 2001 (IT) ..... MI01A1825

(51) Int. Cl.[7] ..... B65B 53/06
(52) U.S. Cl. ..... 432/121; 53/442; 53/557
(58) Field of Search ..... 432/121, 135, 432/136, 143; 53/441, 442, 556, 557; 264/630

(56) References Cited

U.S. PATENT DOCUMENTS 3,760,154 A * 9/1973 Konger ..... 219/388
3,818,182 A * 6/1974 Linde ..... 219/388
4,538,363 A * 9/1985 Zagoroff ..... 34/225
4,574,565 A * 3/1986 Gambetti ..... 53/442
4,965,435 A * 10/1990 Smith et al. ..... 219/388
4,966,547 A * 10/1990 Okuyama et al. ..... 432/9
5,299,406 A * 4/1994 Laury ..... 53/397
5,784,864 A * 7/1998 Laury ..... 53/557

* cited by examiner

*Primary Examiner*—Gregory Wilson
(74) *Attorney, Agent, or Firm*—Hedman & Costigan, P.C.

(57) ABSTRACT

A thermoshrinking tunnel oven for making thermoshrinking plastic material film packages comprises a bottom plate and a top plate having openings for allowing thermoshrinking hot air to pass therethrough, the cross-sections of the openings being controlled by perforated sliders which are independently slidably mounted on the plates.

With respect to conventional tunnel ovens, the inventive tunnel oven and method have the advantage that they provide thermoshrinking material packages of even aspect and devoid of unevennesses.

21 Claims, 10 Drawing Sheets

THERMOSHRINKING TUNNEL OVEN FOR MAKING THERMOSHRINKING PLASTIC MATERIAL FILM PACKAGE AND THE PACKAGING METHOD PERFORMED THEREBY

BACKGROUND OF THE INVENTION

The present invention relates to a tunnel oven for making thermoshrinking material films packages.

The invention also relates to a packaging method for providing packages, the method being carried out in the inventive tunnel oven.

More specifically, the field of the invention is that of the tunnel ovens used for making thermoshrinking material film packages, for example for packaging bottles, cans and the like.

Prior systems for packaging articles in general, such as bottles, cans and so on, in thermoshrinking plastic material films, provide to use heated tunnel ovens, inside which the packages as preliminarily enveloped by the mentioned thermoshrinking film are conveyed.

The oven tunnel is heated by hot air jets, oriented against the articles to be packaged.

The size of the tunnel oven is so selected as to be compatible to the size of the articles to be packaged, to provide an efficient heating and thermo-shrinking process.

The above mentioned prior solutions are however affected by several drawbacks.

At first, the thermoshrinking plastic material films have usually an uneven thickness, which is conventionally modified by the application of decorations or advertisement patterns, which are randomly printed on the film surfaces.

Thus, the aspect of the obtained packages is frequently altered, thereby reflecting an unproper packaging process.

Furthermore, the requirement of designing the oven tunnels with a size related to that of the articles to be packaged represents a great limitation preventing the same oven from being used for articles of different size, i.e. having a size different from that for which the tunnel oven has been constructed.

A further drawback of the tunnel ovens of the prior art is that the film material enveloping the packaged articles tend to adhere to the chain conveying means of the oven, thereby hindering a proper hot air flow, and leaving undesired marks on the bottoms of the packaged articles, and, moreover, undesirably depositing plastic material debris on the oven conveying chains.

SUMMARY OF THE INVENTION

Accordingly, the aim of the present invention is to improve prior tunnel ovens, for making packages devoid of surface unevennesses to be used for a broad range of the article to be packaged size.

The above aim, as well as yet other objects, are achieved by tunnel oven and packaging method as respectively defined by claims 1 and 23.

Preferred embodiments of the tunnel oven and packaging method according to the present invention are defined by the subclaims.

With respect to the prior art, the tunnel oven and packaging method according to the present invention provide the advantage of providing thermoshrinking material packages devoid of surface unevennesses, and of even aspect, owing to the use of controlling means for controlling the air flows.

The invention provides moreover that it allows to process, in the same tunnel oven, packages of differently sized articles.

Furthermore, the provision of control systems for controlling the temperature of the air flow and for cleaning the article conveying chains, provides packages devoid of surface defects.

BRIEF DESCRIPTION OF THE DRAWINGS

The tunnel oven and packaging method according to the present invention will be disclosed in a more detailed manner hereinafter with reference to a preferred embodiment thereof, which is illustrated, by way of an indicative, but not limitative example, in the figures of the accompanying drawings, where.

DESCRIPTION OF THE PREFERRED EMBODIMENTS

Figure 1:
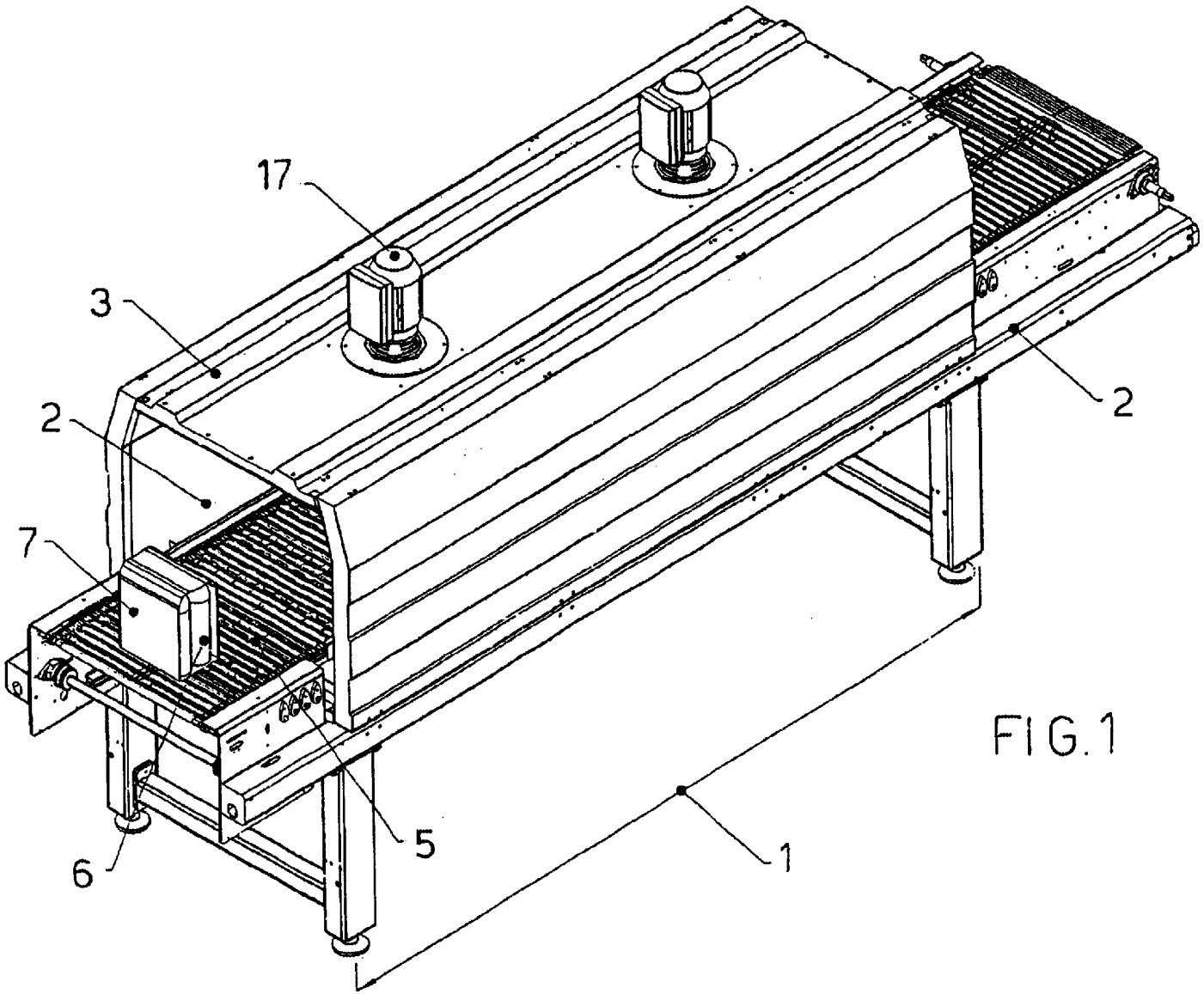
FIG. 1 is a perspective view of the overall tunnel oven according to the present invention.

The tunnel oven according to the present invention has been generally indicated in FIG. 1 by the reference number 1.

Said tunnel oven comprises a bottom supporting base 2, supporting a covering element 3 defining, with said bottom base 2, the thermoshrinking chamber 4 of the tunnel oven.

Said bottom base 2 comprises a chain conveyor 5, provided for receiving a plurality of articles 6 to be packaged (in FIG. 1 said articles comprising bottles) which are preliminarily enveloped by a thermoshrinking material film 7.

Immediately under the package 16 bearing surface, a plurality of fans 8 are provided on the chain conveying means 5.

Figure 4:
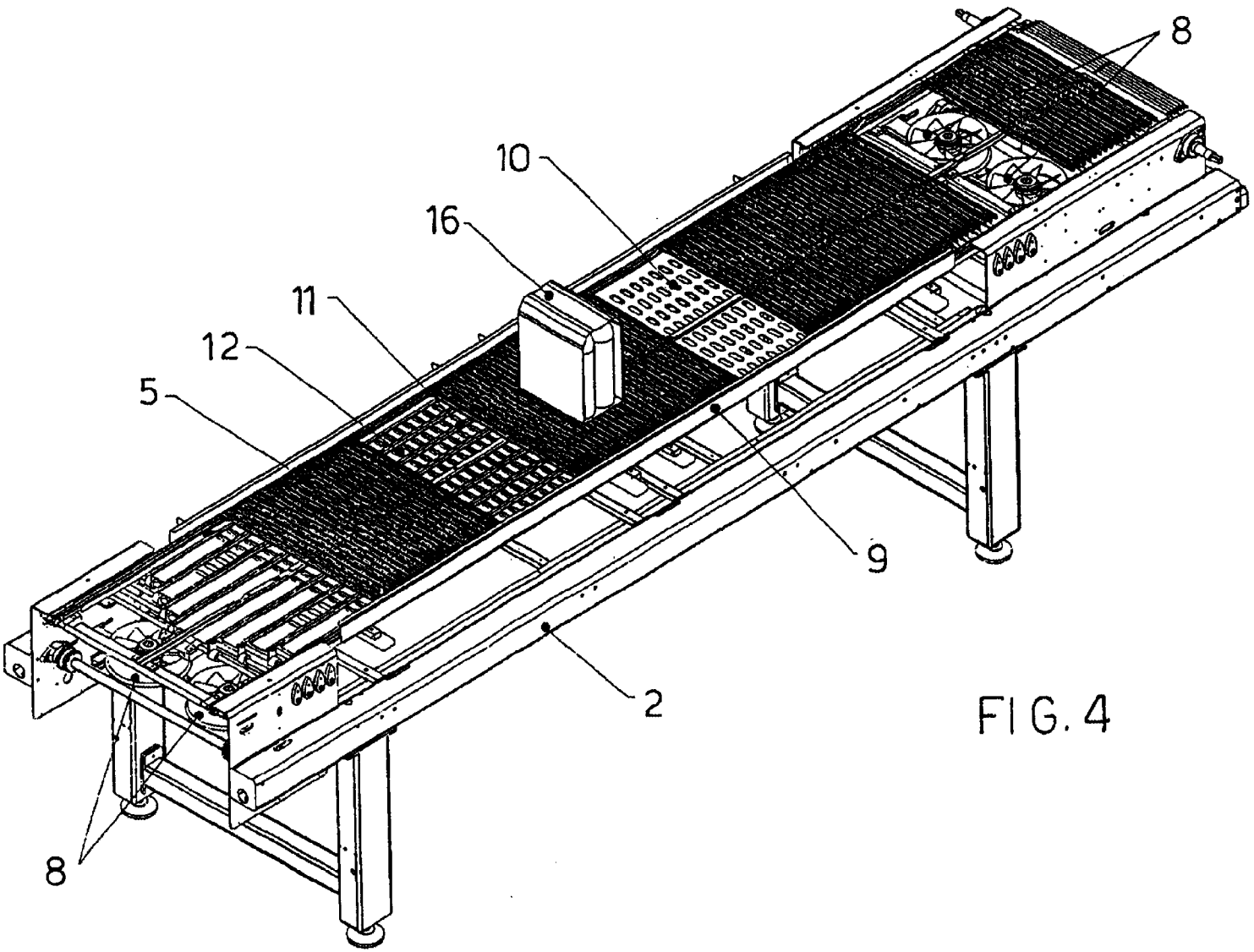
FIG. 4 is a schematic view illustrating the tunnel oven of FIG. 1, with the top covering removed therefrom, in order to show the hot air bottom flow outlets.

As is clearly shown in FIG. 4, the fans are arranged outside the covering element 3 and are designed for cooling down the chain conveying means 5, thereby preventing the chain conveying means for achieving the thermoshrinking temperature of the film 7.

Figure 8:
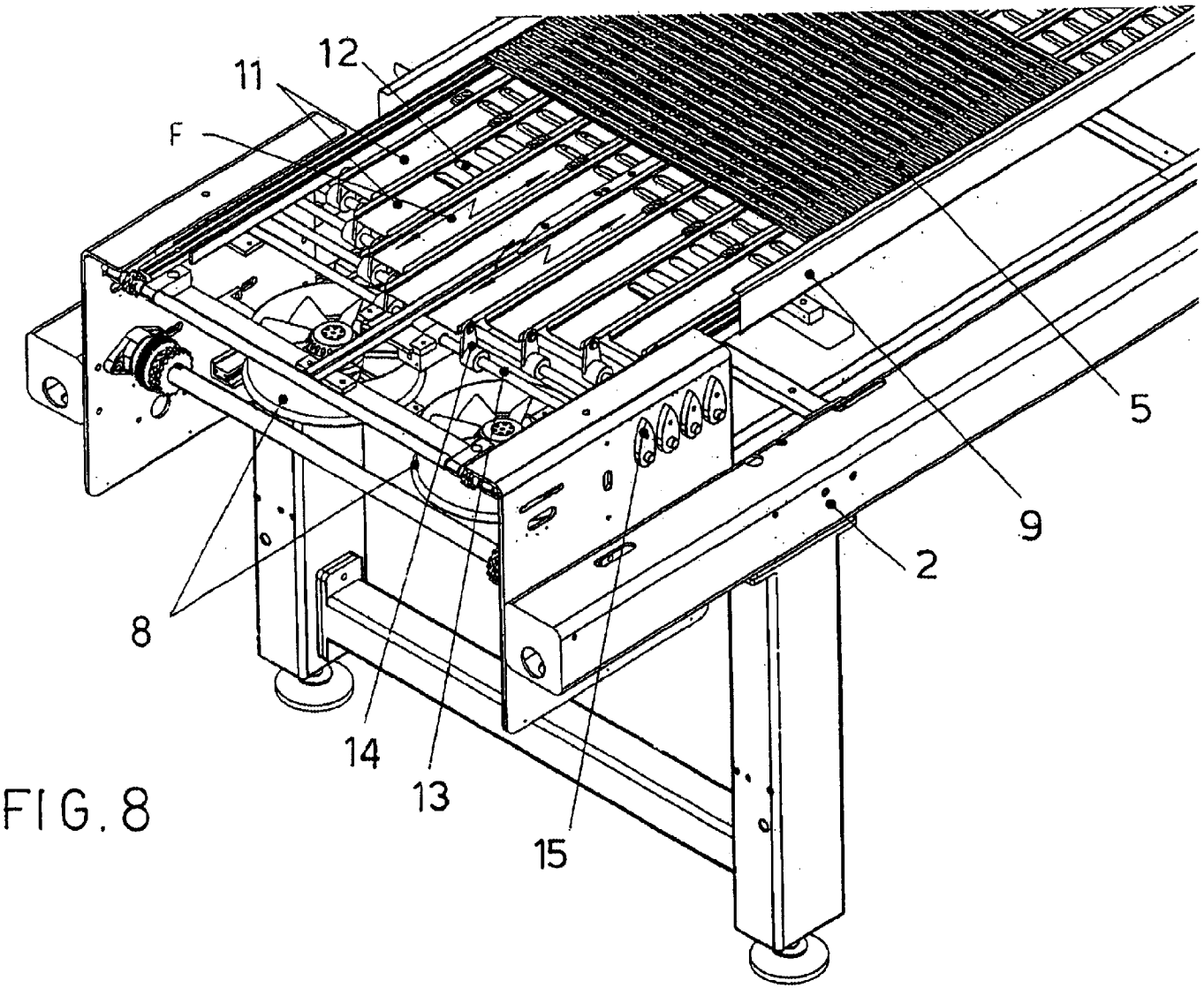
FIG. 8 illustrates the arrangement of the cooling fans of the chain conveying means at the front portion of the tunnel oven shown in FIG. 1.
Figure 10:
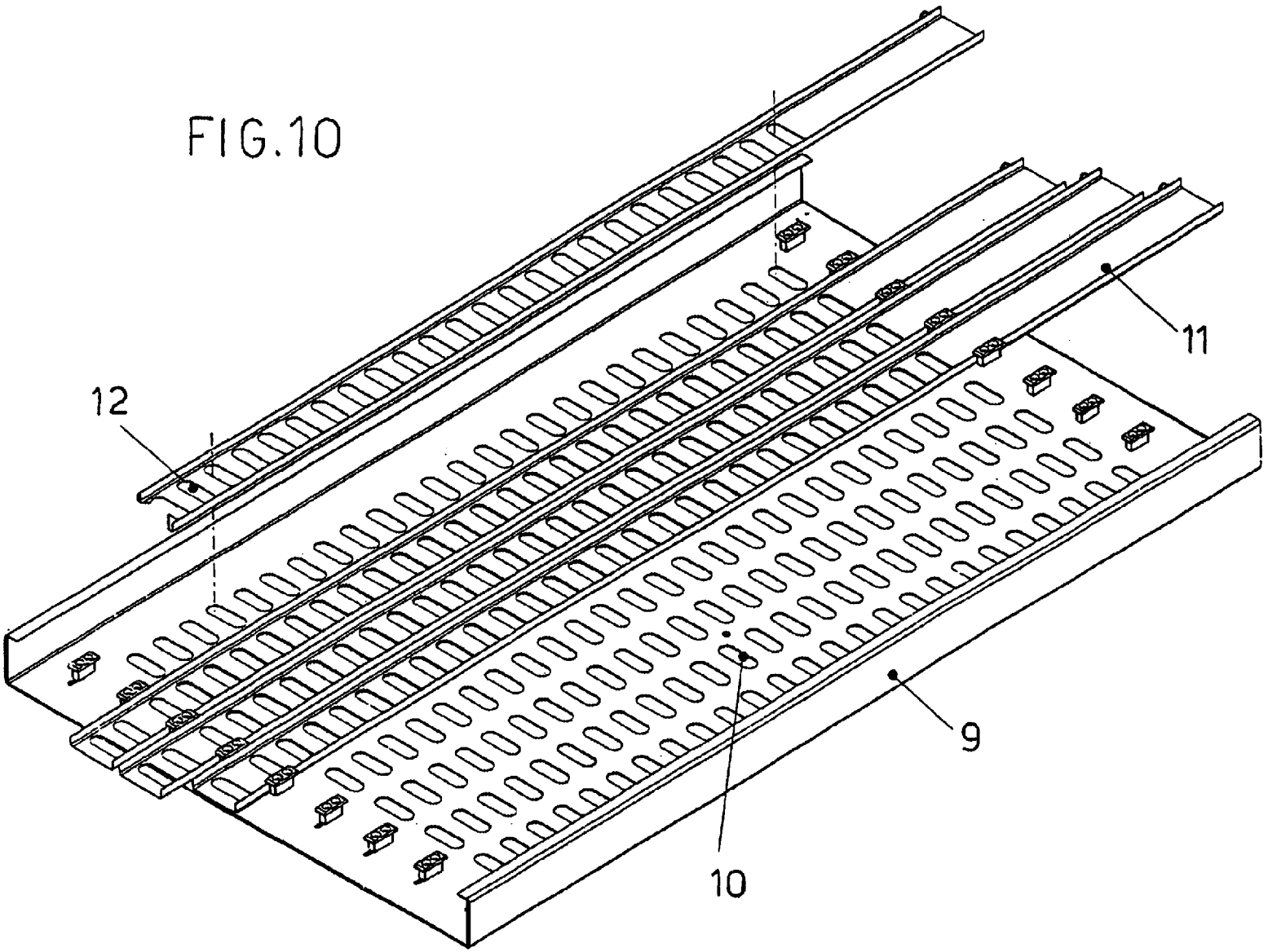
FIG. 10 illustrates a detail of a control device for controlling the bottom air flows of the oven tunnel shown in FIG. 4.

The control means for controlling the hot air flows exiting the bottom portion of the tunnel oven and directed to the packages are shown in FIGS. 4, 8 and 10.

More specifically, said hot air flow control means comprise a plate 9, including a plurality of holes or slots 10, said plate extending through the overall length of the tunnel oven 1.

With said plate 9 are associated slider elements 11, preferably in a overlapping relationship with respect to said plate, said slider elements adjoining one another in a slidable manner and comprising a plurality of holes 12 or perforations, registering with the holes 10 of said plate 9.

The slider elements 11 on the plate 9 are driven, in the direction of the arrows F of FIG. 8, by a driving mechanism including corresponding shafts 13 and levers 14, and in turn driven by corresponding driving knobs 15.

Preferably, the driving knobs 15 controlling the displacement of the slider elements or drawers 11 are independently arranged on the base 2, at both walls and on the two ends of the tunnel oven 1.

Thus, by operating the mentioned driving knobs, it is possible to achieve two different positions of the slider elements or drawers 11 on the plate 9 and, more specifically:

1. a full opening position in which the holes 10 of the plate 9 are fully opened, and the holes 12 of the slider elements 11 are brought into registration with said holes 10, and
2. a fully closing position, in which the holes 10 of the plate 9, with the slider elements 11 are arranged so that the holes 12 thereof are fully offset with respect to the holes of said plate 9.

In this connection it should be apparent that it would be possible to achieve intermediate adjustments, providing a partial closure of the holes 10 of the plate 9.

The bottom base 2 of the tunnel 1 comprises a covering element 3 on which are mounted hot air circulating fans 17.

Figure 2:
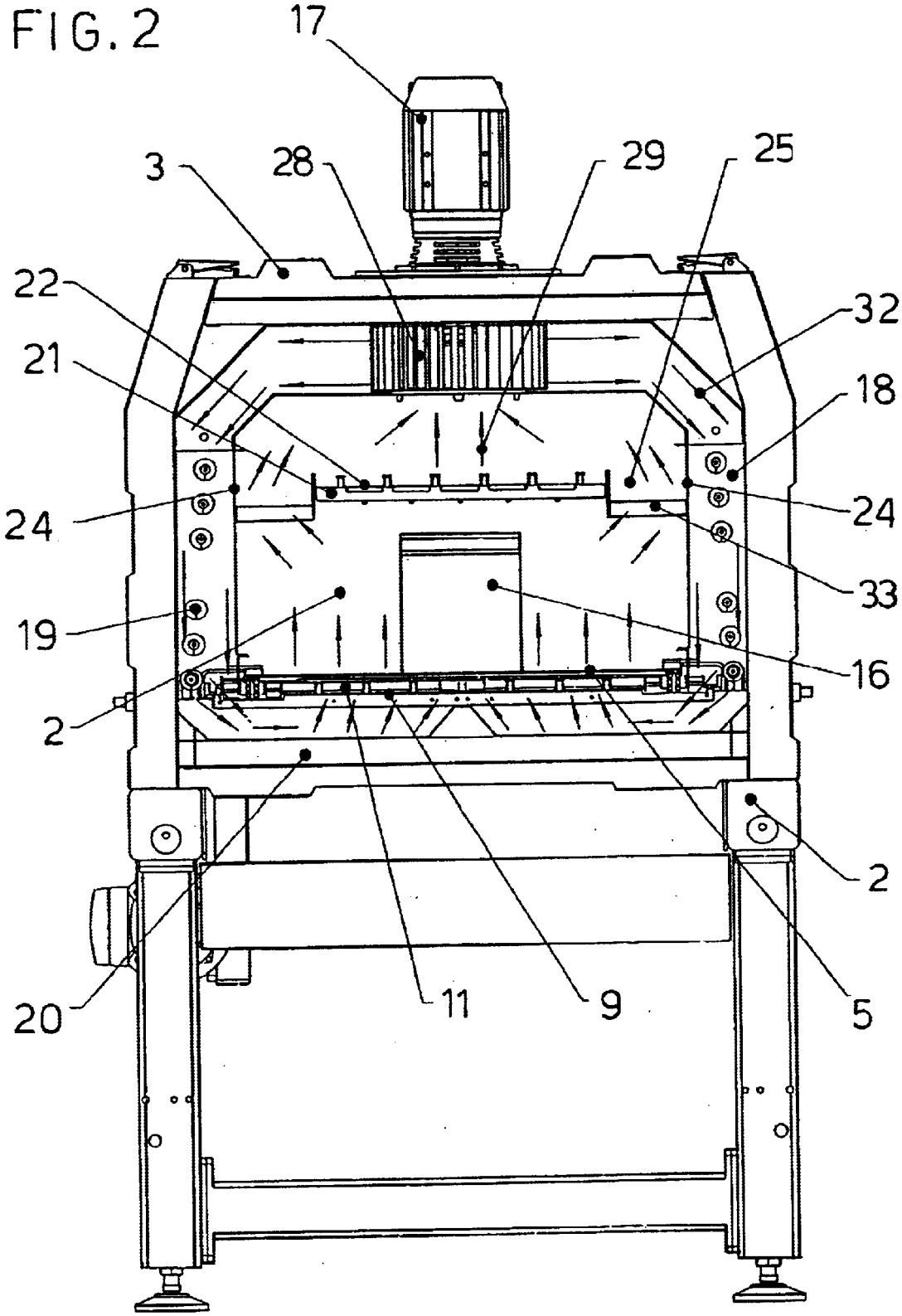
FIG. 2 is a front view illustrating the tunnel oven shown in FIG. 1.

As is clearly shown in FIG. 2, the fans 17 cause air to be directed inside the gap 18 of the covering element 3, in which are arranged resistances 19 for heating said air.

The thus heated air flow is oriented toward the base 2 and is upward directed, starting from the bottom 20 of the thermoshrinking chamber 4, by passing through the holes of the plate 9 and of the slider elements 11.

The air flow provided by said fans 17 is also oriented in the direction of the perforated top plate 21 and perforated top slider element 22 assembly, having a construction and an arrangement analogous to those of the bottom plate 9 and bottom slider elements 11, as thereinabove disclosed.

Figure 5:
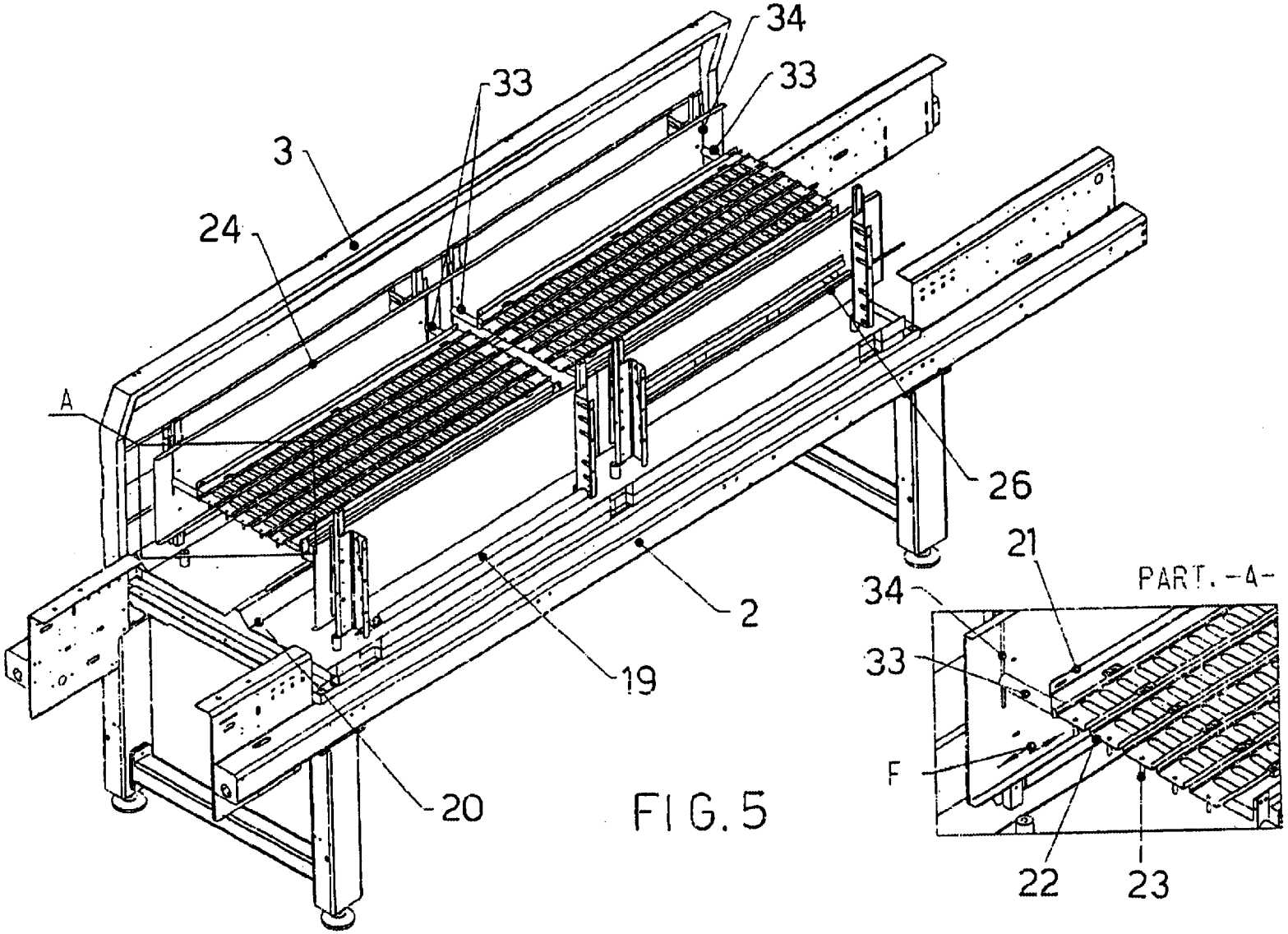
FIG. 5 is a broken away view of the tunnel oven of FIG. 1, specifically showing the deflection outlets or ports for deflecting the hot air top flows toward the oven fan.

In particular, the top slider elements or drawers 22 comprises, at a respective end portion thereof, knobs 23 for driving said slider elements in the direction of the arrows F of FIG. 5, thereby closing, in a partial manner, the holes of the plate 21 for allowing air to enter the thermoshrinking chamber 4.

In order to provide the air flow exiting from the bottom base 2 with a profile like that of the package 16, the top slider elements 22 are so driven as to close the side surfaces of the plate 21, while leaving open the central portion of said plate, corresponding to the position of the package 16.

In this connection it should be apparent that the number of slider elements or drawers which are left open will depend on the size of the packages or number of the simultaneously processed packages.

For some applications, in which the top region of the packages 16 must not be affected by an excessive heat, the holes of the top plate 21 are fully closed by the slider elements 22, and the air upward flowing from the bottom base 2 will be discharged through the openings 25 formed through the top portion of the side walls 24 of the covering element 3.

Figure 6:
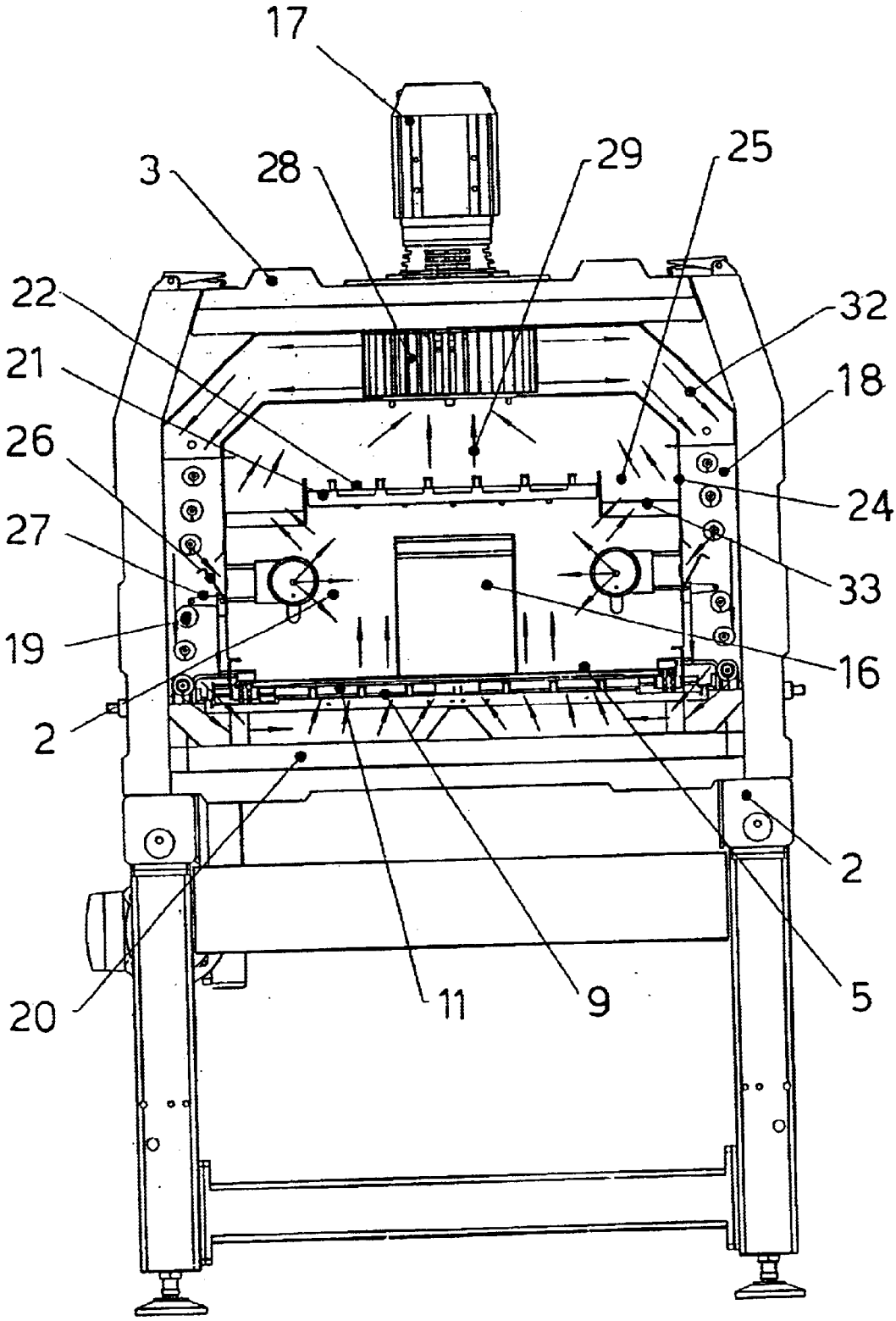
FIG. 6 illustrates the arrangement of the hot air side outlets of the tunnel oven shown in FIG. 2.

In the modified embodiment shown in FIG. 6, the air flow provided by the fans 17 is partially deflected by a baffle 26, driven by a corresponding knob 27, provided on the side walls 24 at the rear portion of the tunnel oven 1, or processed packages outlet portions.

As shown in FIG. 2, the fans 17 draw air from the thermoshrinking chamber in the direction indicated by the arrows 29, at a further fan 28.

Figure 7:
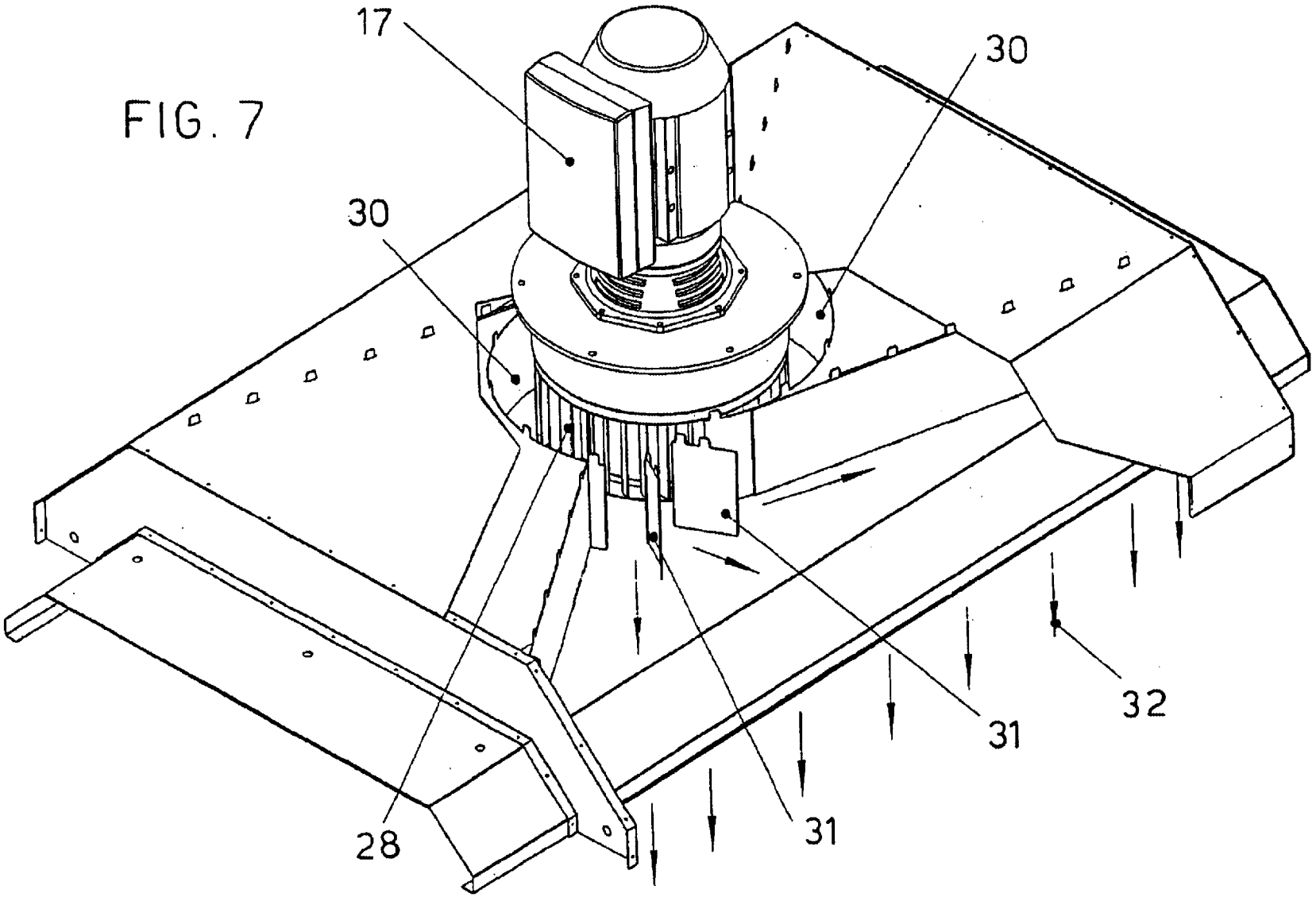
FIG. 7 illustrates the conveying device for conveying the hot air flows to the top portion of the tunnel oven.

Then, as is shown in FIG. 7, the drawn air flow is at the start conveyed into a cyclone 30 and being then conveyed from the latter, by deflecting walls 31, through the overall length of the gap 18 of the covering element 3 (see the arrows 32 of FIG. 2).

The top plate 21 and top slider element 22 system (see FIG. 5) can be arranged, at an adjustable height above the bottom base 2 supporting the chain conveying means 5, by supporting brackets 33 which can slide in slots 34 formed on said side walls 24.

The adjusted in height position of the plate 21 and of the slider elements 22 is locked by locking screws (not shown), operating between the walls 22 and brackets 33.

This height is selected depending on the size of the packages 16 to be processed in the tunnel oven.

Figure 3:
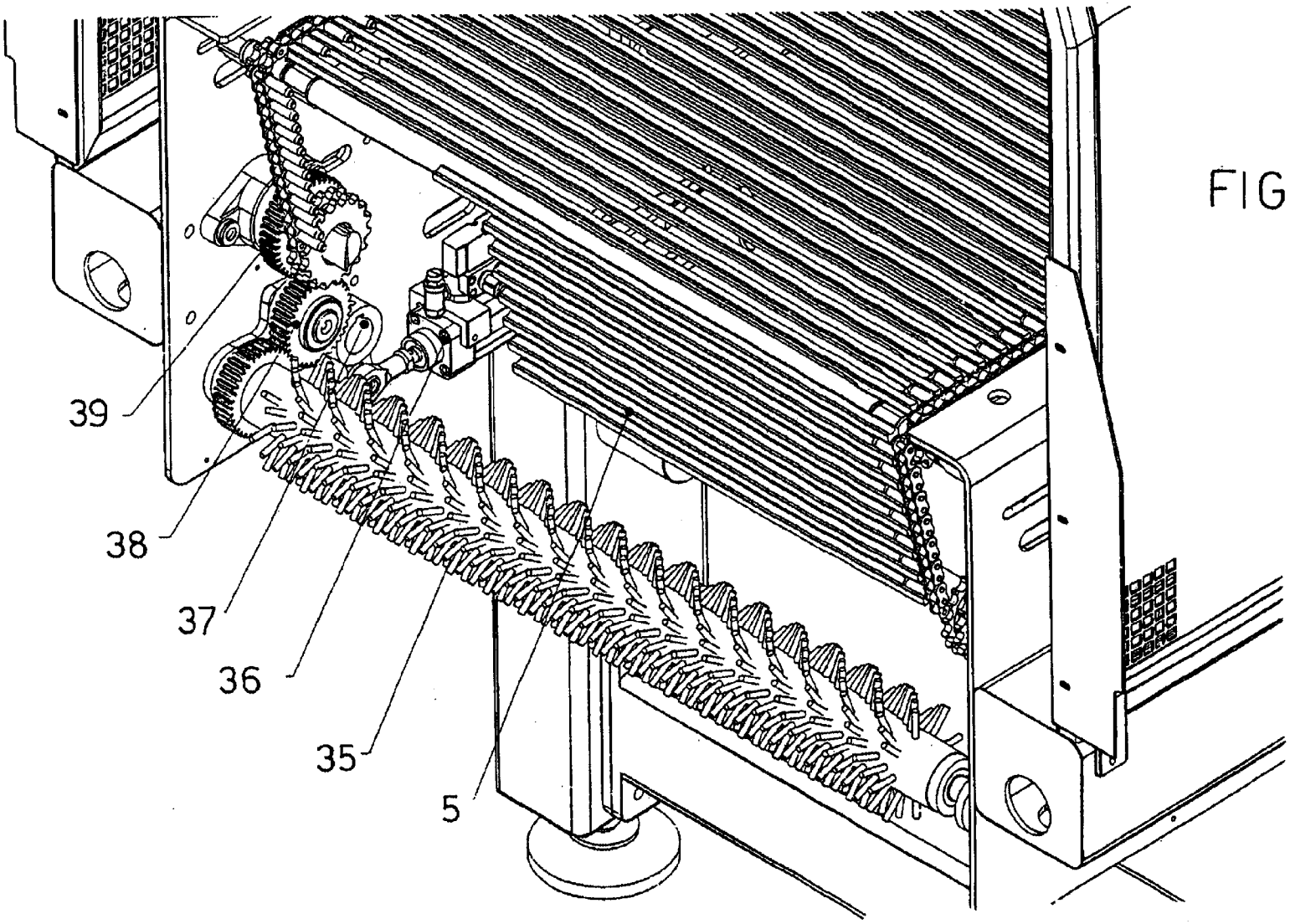
FIG. 3 illustrates a detail of the cleaning device for cleaning the chain conveying means of the tunnel oven shown in FIG. 1.

The cleaning of the chain conveying means 5 is performed by the cleaning device shown in FIG. 3.

This cleaning device comprises a rotary brush 35 arranged at the package 16 inlet region.

For providing an efficient cleaning of the chain conveying means 5, the cleaning brush 35 is advantageously adapted to rotate in a direction opposite to the sliding direction of the conveying chain.

The driving of the cleaning brush 35 is at a temporary driving and is controlled by a pneumatic cylinder 36 driving a brush supporting lever 37.

The lever 37 supports moreover a gear wheel 38 coupled to the brush 35 and engaging with a corresponding gear wheel 39 for driving the chain conveying means.

Thus, as the lever 37 is driven, the two gear wheels 38 and 39 are mutually engaged, thereby causing the cleaning brush 35 to be moved toward the conveying chain 5, to contact the latter.

The driving of the cylinder 36 is controlled by a preset controlling program.

Figure 9:
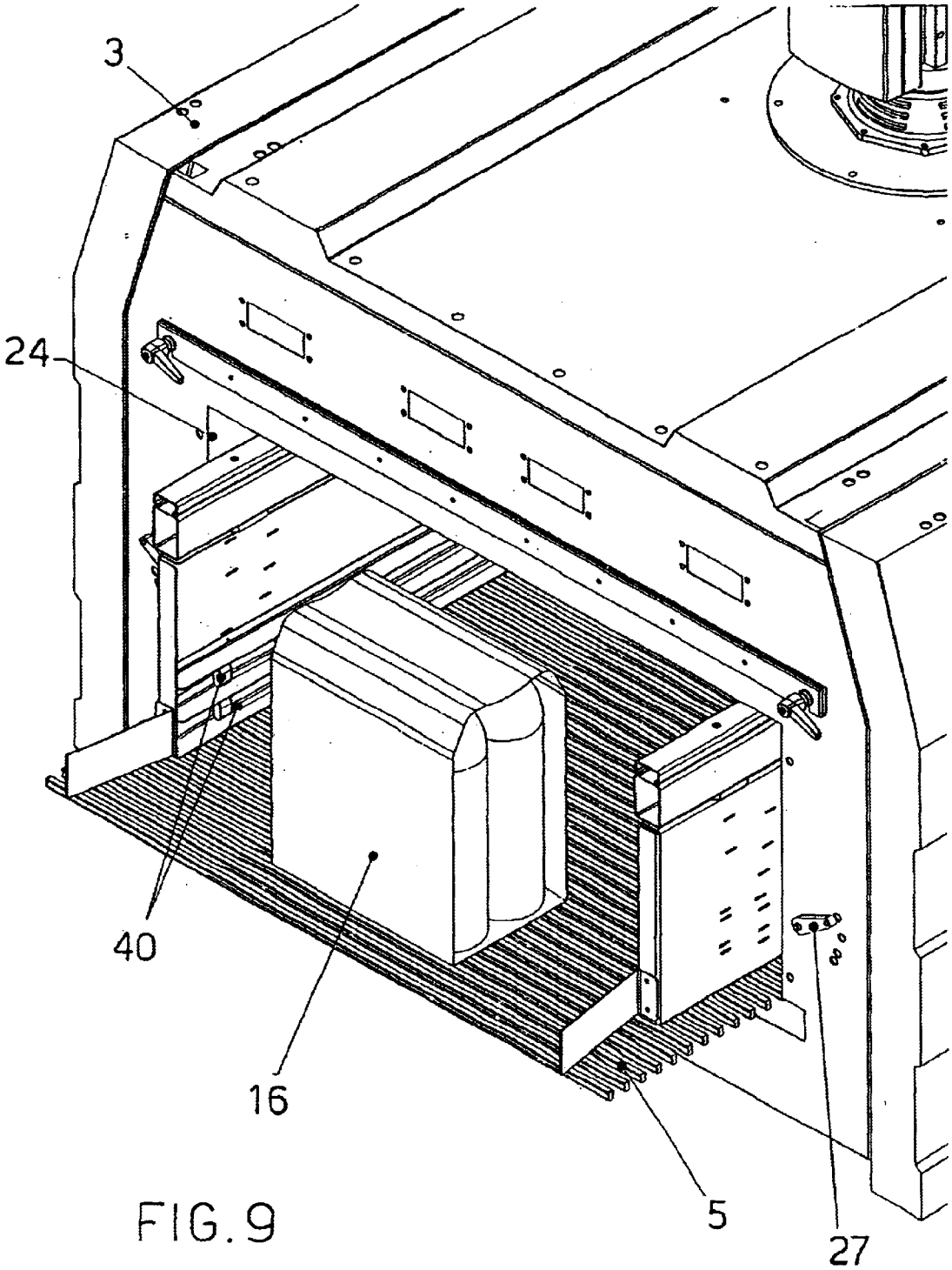
FIG. 9 illustrates a modified embodiment of the tunnel oven shown in FIG. 8.

Advantageously, on the package 16 outlet section, are provided a plurality of IR lamps 40, arranged on the side walls 24 of the covering element 3, as shown in FIG. 9.

If a plurality of packages arranged on a plurality of rows are supplied, then the lamps 40 will be also arranged between a row of packages and another row thereof.

The mentioned lamps operate to concentrate the heat on the side walls of the packages, requiring a great amount of heat as necessary for properly extending the film.

The invention, as disclosed and shown in the figures of the accompanying drawings, is susceptible to several modifications and variations, without departing from the scope of the following claims.

Thus, for example, the plurality of bottom slider elements 11 and top slider elements 22 can be replaced by a single bottom slider element and a single top slider element, even arranged under the related plate, respectively 9 and 21.

What is claimed is:

1. A thermoshrinking tunnel oven for making packages of thermoshrinking material film, characterized in that said thermoshrinking tunnel oven comprises a thermoshrinking chamber and control means for controlling a temperature of said chamber for in turn controlling a thermoshrinking temperature of said film in packages housed in said chamber, said control means comprising a bottom plate arranged under said packages, said plate including a plurality of variable cross-section holes for directing hot air supplied by hot air supplying fans in a direction of said packages, said oven further comprising at least a bottom slider element associated with said bottom plate and including a plurality of perforations which can be displaced between a position coinciding with said holes, thereby leaving said holes fully open, and a position inward or outward offset of said_holes, thereby fully closing said holes, said at least a bottom slider element comprising a shaft and lever driving device, controlled by a corresponding knob, and designed to provide said displacement with respect to said plate, a plurality of mutually adjoining bottom slider elements thereby covering all said bottom plate, said thermoshrinking chamber comprising a covering element and a bottom base, said covering element having walls defining a thermoshrinking air passage gap, for conveying thermoshrinking air under said bottom plate, in said gap a plurality of heating resistances for heating air supplied by said hot air supplying fans, said oven additionally comprising a perforated top plate associated with at least a top perforated slider element which is slidably mounted with respect to said perforated top plate for opening and closing holes of said perforated plate.

2. An oven according to claim 1, characterized in that said oven comprises moreover a plurality of top independently driven slider elements, covering all of said perforated top plate.

3. An oven according to claim 1, characterized in that the side walls of said covering elements have side walls comprising a plurality of openings for discharging thermoshrinking air therefrom.

4. An oven according to claim 1, characterized in that said oven comprises moreover a baffle arranged on said walls of said covering elements.

5. An oven according to claim 1, characterized in that said fans comprises a cyclone and deflecting plates for conveying air through said gap.

6. An oven according to claim 1, characterized in that said oven comprises moreover adjustable height supporting means having a height which can be adjusted with respect to said top plate and said at least a top slider element.

7. An oven according to claim 1, characterized in that said supporting means comprise supporting brackets for supporting said plates and slider elements, said supporting brackets being slidably mounted in corresponding slots formed through said side walls of said covering element.

8. An oven according to claim 1, characterized in that said oven additionally comprises at least a chain conveyor means for conveying said packages to said thermoshrinking chamber, cooling fans for cooling said chain means being arranged under said conveying chain means, outside of said thermoshrinking chamber.

9. An oven according to claim 1, characterized in that said oven additionally comprises cleaning means for cleaning said chain conveyor means as said packages are conveyed and thermoshrunk.

10. An oven according to claim 9, characterized in that said cleaning means comprise a rotary cleaning brush arranged at a package inlet region of said tunnel oven and adapted to clean said chain means as said chain conveys said packages.

11. An oven according to claim 10, characterized in that said cleaning brush is swingably mounted to swing respectively between a position interfering against said chain means for cleaning said chain conveyor means, and a rest position, in which said cleaning brush is removed from said chain means.

12. An oven according to claim 11, characterized in that said oven comprises moreover a supporting lever for supporting said cleaning brush and a gear wheel driving said cleaning brush and supported by said lever, said gear wheel being adapted to engage with a further gear wheel for driving said chain means.

13. An oven according to claim 12, characterized in that said oven comprises moreover a driving cylinder for driving said lever from a disengagement position of said gear wheels to an engagement position of said gear wheels, in which said cleaning brush is rotatively contacted with said chain means.

14. A method for packaging articles in a thermoshrinking film, thermoshrunk in a thermoshrinking tunnel even according to claim 1, said method comprising the steps of providing hot air flows for thermoshrinking said film in said oven controlling a flowrate and a direction of said hot air flows, wherein said step of controlling said hot air flow rate is performed by adjusting a cross-section of said holes of said bottom and top perforated plates supplying hot air to said thermoshrinking chamber of said oven.

15. A method according to claim 14, characterized in that said step of adjusting said holes is performed by causing said perforated slider elements to slide on said respective perforated plates.

16. A method according to claim 14, characterized in that said step of controlling said hot air flow direction is performed by independently driving the top slider elements on their corresponding perforate plates.

17. A method according to claim 16, characterized in that the hot air flow has a profile corresponding to each said package, the top slider elements being so arranged as to close side surfaces of the corresponding plate, while leaving open a central portion of said plate, said central portion corresponding to positions of said packages.

18. A method according to claim 14, characterized in that said method additionally comprises step of cleaning said chain means as said packages are conveyed thereby.

19. A method according to claim 18, characterized in that said chain means cleaning step is performed by contemporaneously causing said brush to contact said chain conveyor means.

20. A method according to claim 19, characterized in that said brush is rotated in a direction opposite to a chain conveyor means sliding direction.

21. A method according to claim 14, characterized in that said method is provided for processing packages of bottles wrapped in said thermoshrinking plastic material film.

* * * * *